United States Patent [19]

McBurnett et al.

[11] 4,336,005

[45] Jun. 22, 1982

[54] GEAR PUMPS AND MOTORS

[75] Inventors: James R. McBurnett; James M. Eley, both of Corinth, Miss.

[73] Assignee: Tyrone Hydraulics, Inc., Corinth, Miss.

[21] Appl. No.: 201,475

[22] Filed: Oct. 28, 1980

Related U.S. Application Data

[63] Continuation-in-part of Ser. No. 29,891, Apr. 13, 1979, Pat. No. 4,266,915, which is a continuation-in-part of Ser. No. 923,094, Jul. 10, 1978, abandoned.

[51] Int. Cl.[3] ..... F04C 15/00

[52] U.S. Cl. ..... 418/126

[58] Field of Search ..... 418/74, 125, 126, 129

[56] References Cited

U.S. PATENT DOCUMENTS

| | | | |
|---|---|---|---|
| 1,118,533 | 7/1913 | Crocker . | |
| 1,783,209 | 12/1930 | Wilsey . | |
| 1,897,560 | 2/1933 | Lawser . | |
| 2,622,534 | 12/1952 | Johnson . | |
| 2,639,694 | 5/1953 | Johnson . | |
| 2,742,862 | 4/1956 | Banker | 418/126 |
| 2,855,854 | 2/1958 | Aspelin . | |
| 2,996,999 | 8/1961 | Trautman | 418/126 |
| 3,315,609 | 4/1967 | Eckerle . | |
| 3,427,985 | 2/1969 | Difford . | |
| 3,429,270 | 2/1969 | Noell et al. . | |
| 3,437,048 | 4/1969 | Noell et al. | 418/129 X |
| 3,472,170 | 10/1969 | Eckerle . | |
| 3,498,232 | 3/1970 | Noell et al. | |
| 3,915,604 | 10/1975 | Kitta et al. | 418/126 X |
| 3,986,800 | 10/1976 | Dworak et al. | 418/126 X |

FOREIGN PATENT DOCUMENTS

| | | | |
|---|---|---|---|
| 625405 | 2/1936 | Fed. Rep. of Germany . | |
| 1267987 | 5/1968 | Fed. Rep. of Germany . | |
| 2604969 | 8/1977 | Fed. Rep. of Germany | 418/126 |

OTHER PUBLICATIONS

New 4000 psi "60 Decibel" Hydraulic Pump / Eckerle-Miller Fluid Power.

*Primary Examiner*—Leonard E. Smith

*Attorney, Agent, or Firm*—Charles H. Lindrooth

[57] ABSTRACT

The disclosure relates to improvements in pumps and motors of the gear type. The gear elements are arranged within the pump or motor housing so that the ends or the tips of the teeth are spaced out of fluid sealing relationship and not pressed into the surrounding chamber wall on the low pressure side of the housing. Rigid sealing members of limited circumferential extent having a curved sealing surface and planar support and side wall surfaces are seated in a recess in the housing at the high pressure side of the gears for the purpose of providing a fluid seal between the tips of the teeth in a limited region adjacent the opening in the housing which is at higher pressure. The sealing members are positioned in a recess in the housing and are configured to be resistant to bending and movement. The sole support for the shoes is provided by planar surfaces on the side pressure plates.

8 Claims, 8 Drawing Figures

Fig. 3.
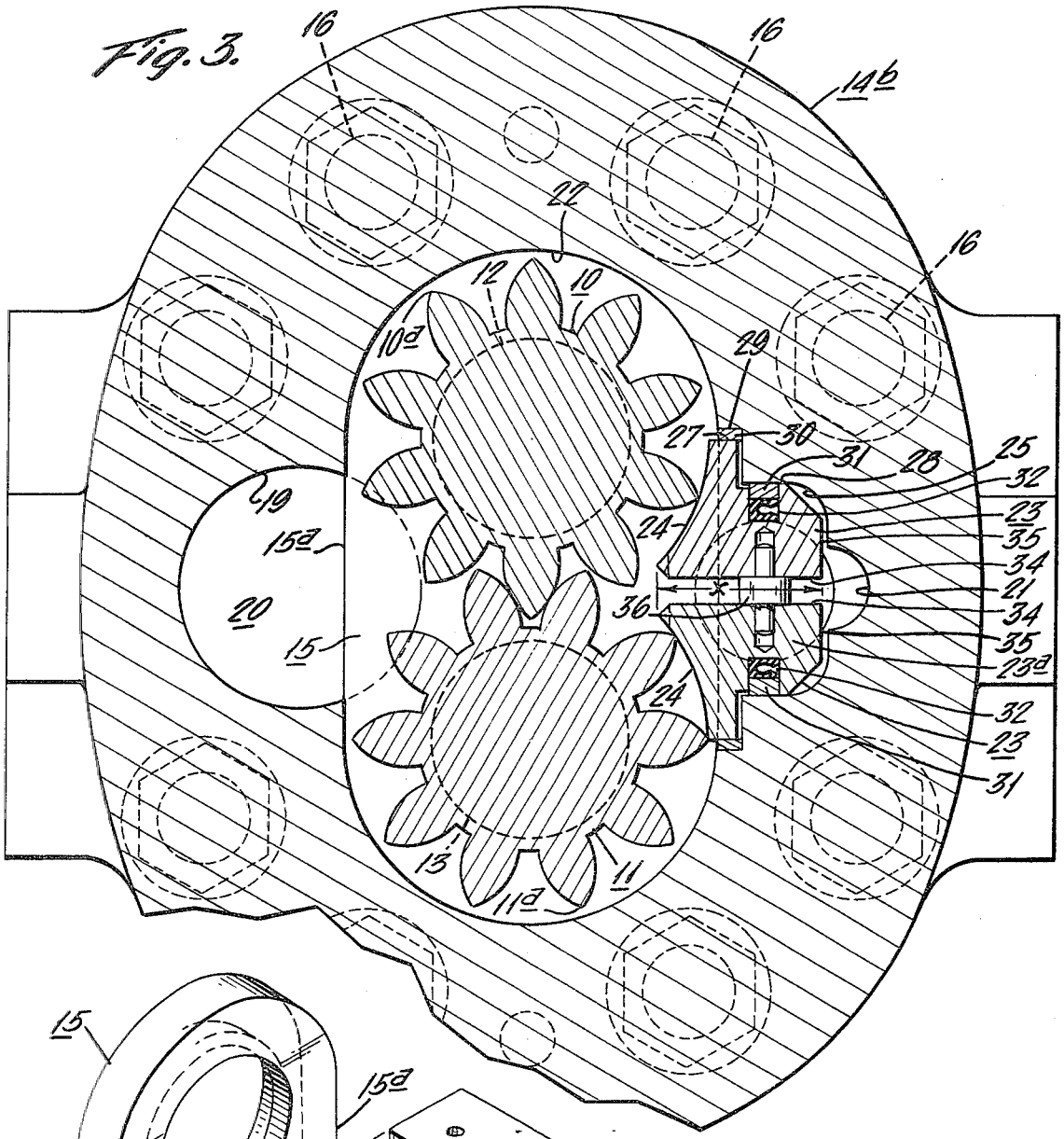
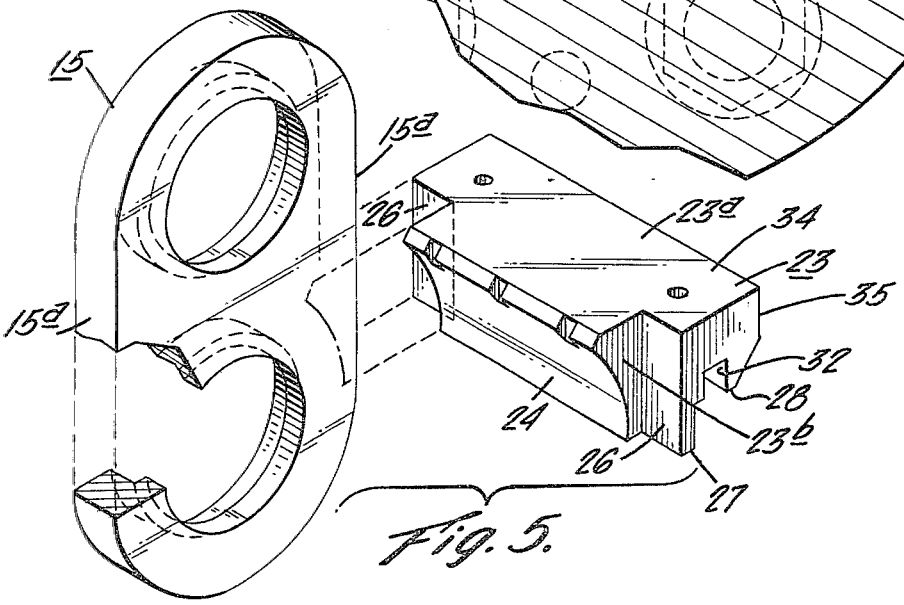
Fig. 5.

GEAR PUMPS AND MOTORS

RELATED APPLICATIONS

This application is a continuation-in-part of our copending application Ser. No. 29,891 filed Apr. 13, 1979 now U.S. Pat. No. 4,266,915 which in turn is a continuation-in-part of our application Ser. No. 923,094, filed July 10, 1978, now abandoned.

FIELD OF THE INVENTION

The invention relates to improvements in hydraulic equipment such as gear pumps and motors, which improvements provide for a reduction in the bearing loads and in the stresses imposed on vital parts, thereby resulting in increased durability, prolonged life and increases in operating efficiency.

BACKGROUND OF THE INVENTION

As is generally recognized by those of ordinary skill in the art, hydraulic pumps and motors of the gear type have found widespread use in heavy equipment and in various other implements wherein loads several times larger than were contemplated only a few years ago are involved. Obviously, this leads to much larger stresses being imposed on vital parts in the pump or motor which in turn increases the possibility of failure of an overloaded part. Usually when a failure occurs under conditions of actual use, it occurs with little warning so that a major breakdown of the equipment may occur when the equipment is in the field and repair parts and facilities are unavailable. It is recognized in the design of conventional gear pumps and motors that the severe load imposed on the bearings because of the substantial pressure differential which exists between the inlet and the outlet side when a pump or motor is under load is a frequent cause of failure. In modern hydraulic equipment a pressure differential of several thousand p.s.i. may exist across the gears. In a conventional gear pump, this pressure differential forces the gears and the side sealing plates against the interior wall portions of the housing on the inlet side, that is, the low pressure side of the gears. In fact, it has become accepted practice in the manufacture of gear pumps and motors to design the parts with the expectation that during the course of a break-in period, the housing wall on the low pressure side of the gears is gradually machined by a cutting and wearing action of the gear teeth to a matching configuration. As described in our copending application, sometimes the action of the teeth as cutters causes a tearing out of pieces of the housing at points where minor imperfections in the casting are present causing a destruction of the pump. Even if the pump housing is not damaged during break-in, as the pump is used, the machined region of the housing will continue to be gradually worn away. The inevitable result is a progressive loss in efficiency due to a less perfect seal between the teeth and housing interior, or a failure of some critical part. Should the bearings fail, the gear teeth cut into the housing thereby generating a large amount of contamination and the probable destruction of the pump. Although these problems can be alleviated by careful manufacturing and inspection procedures, and by selection of proper materials and the use of ample safety factors, the problems described constitute an inherent limitation to presently existing designs.

SUMMARY AND OBJECTS OF THE INVENTION

The present invention is concerned with pumps and motors of the general kind above referred to and has as a major object, the incorporation of design features which reduce the effects of the differential pressure acting on gear-type pump or motor elements and which eliminate or substantially reduce pump and motor failures attributable to the pressure differential acting on the gear elements. In this and certain other respects the objects of this invention are identical to the objectives outlined in our prior copending application Ser. No. 28,891 referred to above. Still further the invention results in improvements in the stress distribution in the housings of pumps and motors as compared with the configuration disclosed in our copending application and in avoidance of problems of mechanical hysteresis. An important feature of the invention is that the reduction in the size of the high pressure region or pressure pocket is retained while providing other improvements in performance. This reduces housing stresses and leakage paths substantially and bearing loads by at least onethird as compared with conventional gear pumps. Contamination resistance and erosion resistance are substantially improved. In the event of a bearing or shaft failure, very little contamination is generated as compared with prior designs. Usually a failed pump incorporating the principles of the present invention can be readily repaired whereas failure of prior art gear pumps usually meant replacement of the pump. An important consideration is that a failure creates very small amounts of contaminants as a failure causes the gears to move into the clearance area on the low pressure side of the housing. As a consequence of this, parts can be replaced or a new pump installed without the need to drain or clean the hydraulic fluid.

In addition to the foregoing, the present invention relates to improvements in the design, construction and operation of radial sealing elements and mounting means for such elements, as compared with the design configurations disclosed in our copending applications referred to above. An important feature of the present invention is the provision of radial sealing shoes which are highly resistant to bending, even at pressures as high as 5,000 p.s.i. Another important feature of the invention is the provision of design features which reduce movements of the shoes when under load consequently reducing wear and mechanical hysteresis effects.

An important object of the invention is the reduction of wear and prolongation of life of gear pumps and motors.

A further objective of the invention is the provision of means in a gear pump of given size, for increasing the volume of the pump inlet chamber and hence the ability of the pump to fill with resultant increase in efficiency as compared with prior designs.

Still another objective of the invention is the reduction of the stresses and improvements in the distribution of stresses to which castings, bearings and other parts of gear pumps and motors are subjected without sacrificing the performance characteristics of the pump or motor.

A further objective of the invention is the provision of design features which eliminate or substantially reduce the break-in period required with prior gear pump and motor designs.

A still further objective of the invention is the provision of a gear pump and motor design which permits operation with zero or oil film tolerances at the tooth tips thereby reducing leakage, and eliminating any tendency of the teeth to wear and to produce chips of housing material when under load.

Another object of the invention is to reduce the effect of increased temperature when using dissimilar metals for housing and gears (i.e. aluminum housing, steel gears).

Another object of the invention is the reduction of the effects of operating with particulate contaminated fluid by reducing the effective sealing lengths and therefore reducing the area exposed to contaminated fluid under pressure.

A further objective of the invention is the provision of an economical high performance gear pump in which the radial pressure sealing members can be made of materials which are highly resistant to erosion without appreciably increasing pump costs.

A still further objective of the invention is the provision of a gear pump which is simpler and more economical to repair than prior designs.

Another object of the invention is the provision of a gear pump wherein little or no contamination is generated in the event of bearing failure.

In summary, the foregoing objects of the invention are achieved by the provision in a gear pump or motor of pairs of radial sealing shoes which are loaded toward the gear teeth by hydraulic fluid pressure. During break-in, the gears track in to these sealing shoes to provide minimum tip clearance. The shoes are supported on specially designed side plates so that the load on them is distributed into the housing rather than the gears or shaft bearings. Preferably, the shoes are readily replaceable and since they are not pressure vessels they may be comprised of various materials such as materials which are highly resistant to erosion thereby increasing the useful range of operating pressures for which the pumps may be utilized. Shoes of the same design are provided at the high pressure inlet of a motor, in a gear motor configuration.

Other objects and advantages of the invention will become apparent upon reference to the following description of a preferred embodiment of the invention.

BRIEF DESCRIPTION OF THE DRAWINGS

In the drawings:

FIG. 3 is a sectional view taken along line 3—3 of FIG. 2;

FIG. 5 is a perspective view of a sealing shoe and side plate of the type shown in the FIGS. 3 and 4;

DETAILED DESCRIPTION OF THE INVENTION

Figure 1:
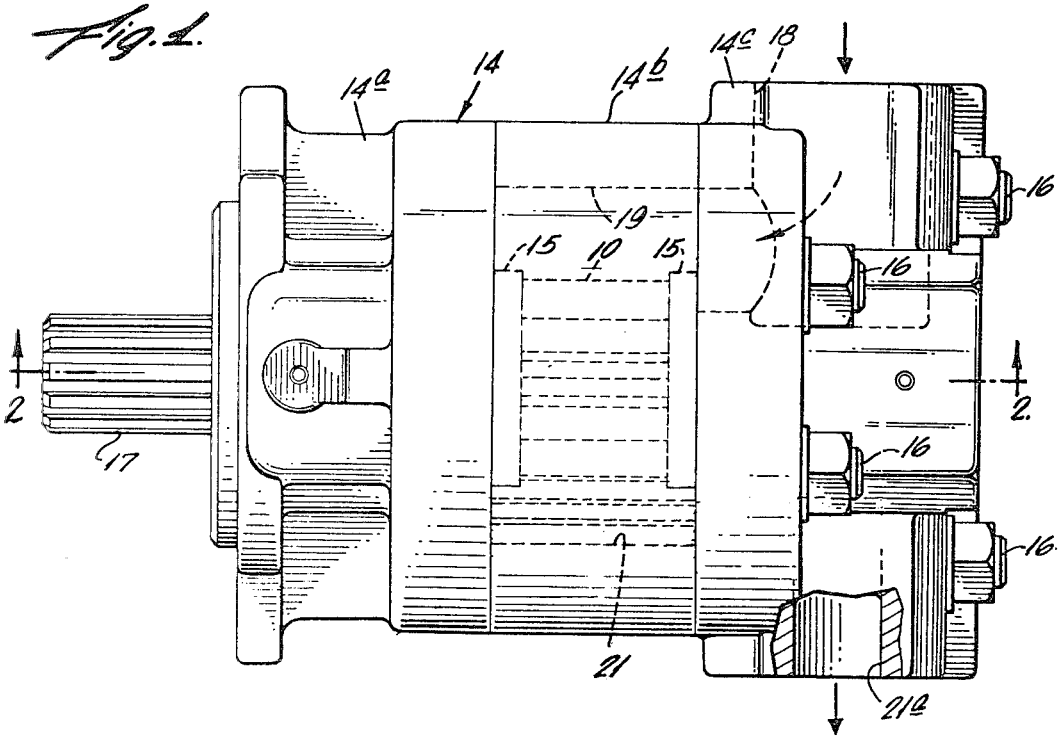
FIG. 1 is an exterior view of a typical hydraulic gear pump incorporating the principles of the present invention with portions of the housing broken away for purposes of illustration.
Figure 7:
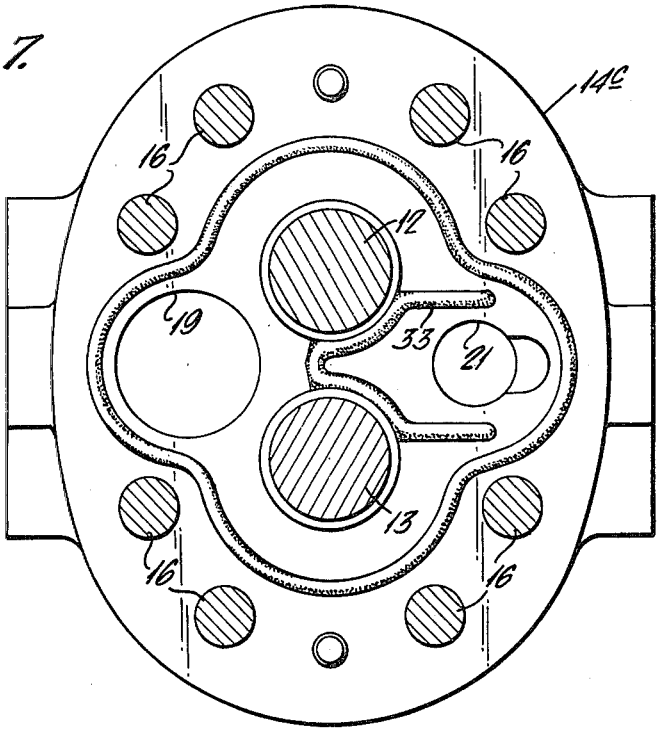
FIG. 7 is a view taken on line 7—7 of FIG. 2.
Figure 8:
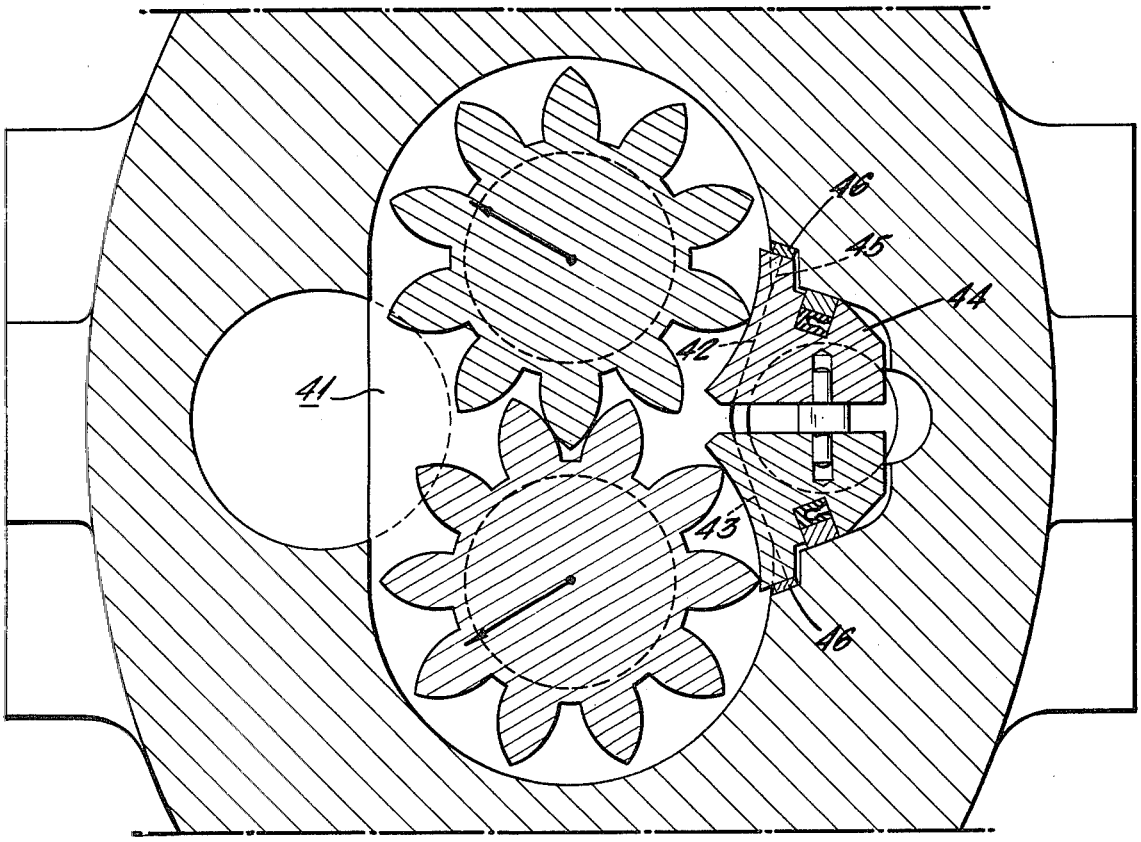
FIG. 8 is a view similar to FIG. 3 showing a modified form of the present invention.

Reference is made to the drawings, especially FIGS. 1 and 3, wherein the invention is shown as embodied in a typical gear pump in which a pair of gears 10 and 11 are provided as pumping elements for pumping hydraulic fluid from a reservoir to a hydraulically operated device, not shown. Gears 10 and 11 are mounted on parallel shafts 12 and 13, best shown in FIG. 2, and journalled in sleeve-type bearings within a housing 14. Side pressure plates 15 are provided on both sides of the rotating gears. As can be seen in FIGS. 3, 7 and 8, the side plates 15 have an oval shape with planar side walls 15*a* which are tangent to the circular end portions. The side plates are confined within an oval recess in the housing and are provided with circular openings through which the gear shafts extend. Although the side plates are free to move a limited amount axially of the gears so that they can be pressure loaded to form a seal at the sides of the teeth, it is important that there be adequate support on the low pressure side in directions perpendicular to the shaft axes. As compared with prior designs wherein the plates are formed in a "figure 8" configuration, the oval configuration imparts to these plates a higher degree of rigidity.

The housing 14 is typically split into two or more components, a three piece housing being illustrated. The three pieces, identified by the reference characters 14*a*, 14*b*, and 14*c*, are secured together by suitable means such as bolts 16.

As can be best seen in FIG. 1, shaft 13 projects outside of the housing 14 and is provided with a splined drive connection 17 which comprises a drive means which also includes a motor, not shown.

An inlet line represented at 18 in FIG. 1 leads to an inlet opening 19 which in turn leads to the hollow housing chamber 20 within which the gears are located, as best illustrated in FIG. 3. The chamber has an outlet 21 located on the opposite side of gears 10 and 11 from the inlet 19. Outlet 21 leads to the hydraulically operated equipment, not shown.

Figure 2:
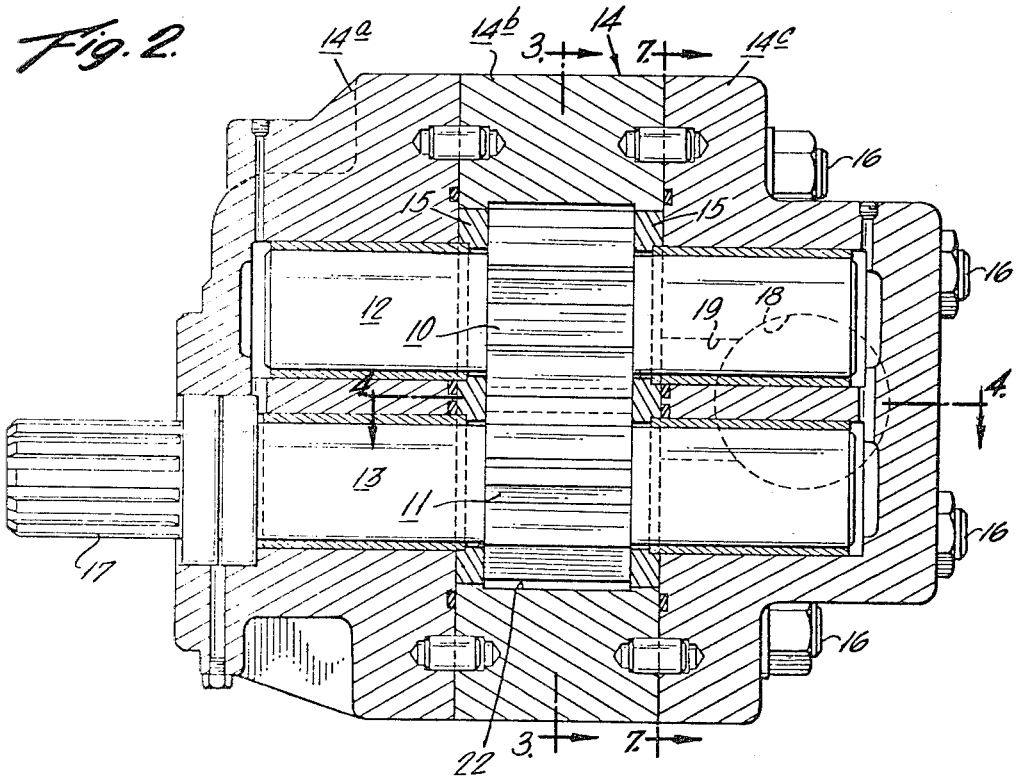
FIG. 2 is a sectional view taken along line 2—2 of FIG. 1.

As is best shown in FIGS. 2 and 3, the interior of the housing is relieved or otherwise formed so that there is a substantial clearance space between the tips of the gear teeh at the addendum circle as shown at 10*a* and 11*a*, and the inner periphery of the housing wall as shown at 22. This clearance space runs from the inlet region 19 circumferentially of each gear to a point at which radial sealing means are located adjacent the outlet 21. According to the invention, the distance between the teeth tips and the wall 22 on the low pressure side of the gears is such that even in the event of bearing failure the teeth do not contact the wall.

In carrying out the invention, the sealing means preferably comprise shoes 23 which are separated for independent positioning adjacent each side of the outlet. Preferably, the shoes 23 fit within a recess 24, formed into the housing 14*b*, so as to extend across the entire face fo the gears.

Figure 4:
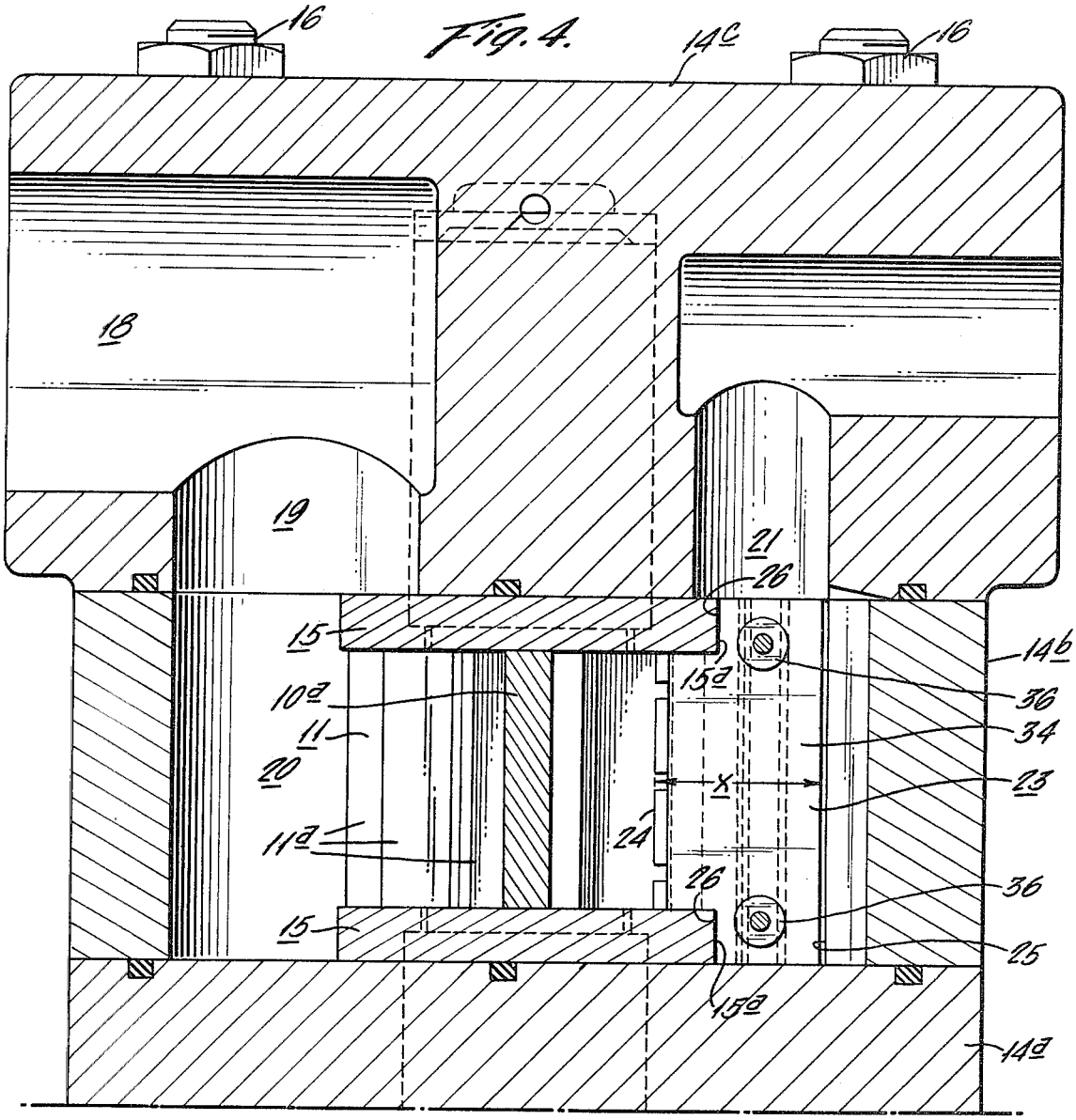
FIG. 4 is a sectional view taken on lines 4—4 of FIG. 2.

With particular reference to FIGS. 3–5, each shoe 23 is comprised of a body part generally indicated at 23*a* and a sealing part 23*b* having an arcuate sealing surface 24 which conforms to the path generated by the tips of the gear teeth. The body fits within a recess 25 in the pump housing and is formed with flat support surfaces 26 extending laterally from the sides of the sealing part. These support surfaces rest on the flat surfaces 15*a* of the side pressure plates 15 so that the side pressure plates provide the sole support for the shoes with the sealing surfaces 24 forming a fluid seal with the teeth tips. The plates in turn are firmly supported by the housing on the low pressure side so that the forces exerted on the shoes are transmitted to the housing and not to the gears or bearings.

Each shoe further has a stepped back including surfaces 27 and 28. The surface 27 should be substantially perpendicular to support surface 26 and interfaces with a flat surface 29 of recess 25. Preferably a thrust pad 30 of steel or the like is placed between surface 27 and 29 with freedom to float.

A flexible seal 31 fits within a groove 32 formed in surface 28. The seal cooperates with the interfacing surface of the recess 24 and intersects a seal 33 in housing section 14*c* so as to define and limit the surface portion of the shoes exposed to high pressure. Seal 31 is preferably positioned close to surface 27 so that a relatively large area of the back of the shoe is exposed to high pressure as compared to the area exposed to low pressure.

The shoes further have facing flat surfaces 34 and rear surfaces 35. The surfaces 34 are held apart by a spacer 36 which maintains them in spaced, parallel relationship within the recess in the absence of pressure and defines a flow path for high pressure fluid to the discharge opening 21. As should be evident from FIG. 3, the high pressure region or pocket extends from the line of contact of those teeth in contact with the sealing surfaces to the rear surfaces of the bodies of the shoes, to the flexible sealing members 31. The ends of the sealing member 31 overlap the ends of sealing members 33 in side sections of the housing 14*a* and 14*c*, to define sealed pressure regions behind the shoes. It can be seen from FIG. 3 that the discharge pressure is communicated to this region behind the shoes as limited by the seals 31 and 33 and acts to press the flat supports on the shoes in the horizontal direction, as viewed in FIG. 3, against the flat edges of the side plates so that the sealing surfaces are maintained in sealing relationship with the tips of the teeth. Preferably, the shoes are dimensioned when initially made so that when the pump is finally assembled, the gears track into the shoes slightly, cutting their final clearance, and thus assuming a good seal between the teeth and the shoes.

As should be evident from the above, the function of the shoes is to provide a fluid seal with the tips of those teeth 10*a* and 11*a* in the limited region immediately adjacent the high pressure side of the gears, which in the case of the pump is the outlet 21. As is shown in FIG. 3, these sealing shoes subdivide the interior of the housing into a relatively large inlet chamber portion which extends from inlet port 19 to the point where the teeth tips engage the surface of a shoe 23 wherein the fluid pressure is substantially zero and a relatively small outlet chamber portion wherein the pressure is the full discharge pressure.

Although the sealing surfaces of the shoes 23 can be made longer than is shown in FIG. 3, the preferred length of the sealing surface of each shoe is such that as the lead tooth on a gear moves to a line on the surface at which the notches on the shoe allow the full discharge pressure to be communicated to the pocket defined by the lead tooth and the following tooth, the following tooth has effected a seal with the shoe. Thus no more than two teeth at any given time are in full sealing relationship with the sealing surfaces of the shoes. In operation, this means that the full discharge pressure is limited in its application to the area of those teeth immediately adjacent the outlet. This pressure acts to push the shoes apart in a vertical direction as viewed in FIG. 3 and also acts against the backs of the shoes in a substantially horizontal direction as viewed in FIG. 3 within the limits of the space defined by seals 28. The net effect is to press the shoes against the flat surfaces 15*a* of the side pressure plates with the sealing surfaces in sealing relationship with the teeth. It should be noted that the fluid pressure in the cavity between any two teeth in sealing relationship with the elements 23 is at an intermediate value somewhat below the discharge pressure whereas the remainder of the cavity 20 which encompasses over two-thirds of the circumference of the gears is at low pressure.

The configuration of sealing shoe of the present invention permits a relatively long dimension "X" along face 25 without an increase in the force acting to press the shoe towards the support surface on the side plate or against the sides 29 of the recess. Since stiffness is increased by the cube of the depth, i.e. dimension "X", of the shoe a high degree of resistance to bending can be achieved even at pressures as high as 5,000 p.s.i.

Figure 6:
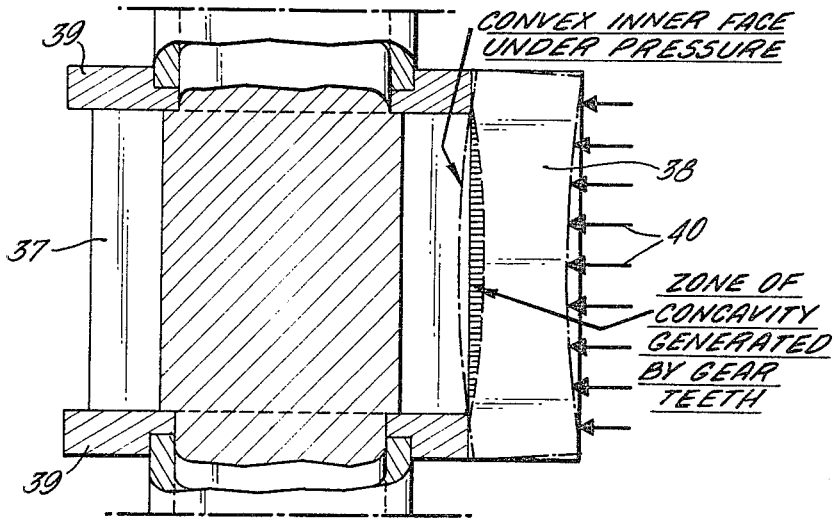
FIG. 6 is a schematic view illustrating the significance of rigidity in radial sealing shoes formed according to present invention.

The consequences of bending of a shoe not having resistance to bending are illustrated in FIG. 6. FIG. 6 illustrates a gear 37 and a radial sealing member 38 supported on side plates 39. As pressure at the back of the shoe is increased to a maximum value as shown by the arrows 40, the load on the shoe has a tendency to bend it at the center toward the gear teeth. Te milling action of the teeth will remove this metal on the sealing surfaces of the shoe. When the pressure is reduced, the shoe returns towards its original position leaving a clearance space represented by the shaded area in FIG. 6 at pressures below the maximum pressure. This clearance space permits a flow of oil over the tips of the teeth with a consequent loss of volumetric efficiency at all pressures below the maximum pressure. The present invention, and in particular the increase in stiffness of the shoe and the configuration of pressure plates employed, insures that this concavity is reduced to a minimal amount.

As indicated above, a thrust pad 30 is provided at the back surface of each of the shoes. This thrust pad substantially reduces the tendency towards fretting between the shoes and the housing.

The configuration of recess and sealing shoe also results in very little movement of the shoes relative to the housing recess. One reason for this is that the forces on the shoe tend to urge it perpendicularly to the load support surface 15*a* and also in a direction against the surfaces of the recess 24.

The mating flat surfaces on the shoes and the recess and the relatively large angle between surface 27 and support surface 26 also substantially eliminate any tendency for the shoes to wedge between the side pressure plates and the housing. Although the shoe configuration of Applicant's copending application is quite effective, it was discovered that high pressures actually expanded the recess within which the shoes seated and the forces tending to separate the shoes wedged them into this expanded space. When pressure was decreased from a high value back to a minimum, the housing contracted and the shoes tended to held in the separated position. In actual tests, this wedging was shown to produce a difference in flow rate of 4 or 5 gallons per minute at an intermediate pressure, for increasing versus decreasing pressure. With the present design, a tendency for the parts to wedge was substantially reduced so that under identical conditions the difference in flow for increasing versus decreasing pressure was reduced to about one gallon per minute.

A wide choice of materials which would be impractical to select as material for the entire housing is available for the shoes. For example, the sealing surfaces may be plated with materials having high abrasion and erosion resistance. An important factor which causes deterioration of conventional gear pumps and motors under severe pressure and temperature conditions is erosion across the tips of the teeth. Erosion-resistant materials such as hard bronze or steel which would be unsuitable or too expensive for entire housings can be chosen for use on the sealing surfaces fo the shoes. Such materials show no appreciable increase in deterioration from erosion at pressures between 3000 and 4000 p.s.i., substantially increasing the range of usefulness of the pumps.

The construction shown in FIGS. 1 to 5 effects a reduction in the unit load on the bearings by a substantial reduction in the area of the gears exposed to the discharge pressure. In turn, the loading on other pump parts is correspondingly reduced. The use of sealing shoes adjacent the high pressure side of the pump or motor allows for a zero or oil film clearance with the tips of the teeth. Since the gears are not pressed into contact with the housing, the break-in period is reduced and the problems of housing wear in the inlet region are eliminated. Another advantage of the invention is that little contamination is generated in the event of bearing failure since a failure causes the gears to move into the clearance space on the low pressure side of the pump or motor. Bearing failure causes the gears to move away from the sealing shoes on the high pressure side and pump flow will drop to zero. Another advantage is that worn pumps and motors which have not had bearing failures can be more readily repaired than heretofor. Gears, pressure plates and sealing shoes can be simply replaced, providing like-new performance at a cost well below the cost of a new pump.

FIG. 8 shows a modified form of shoe and pressure plate. In the embodiment of FIG. 8, the side pressure plates, one of which is shown at 41 are provided with a shallow "V" shaped recess comprised of inclined surfaces 42 and 43. Sealing shoes 44 are similar in configuration to shoes 23 have planar support surfaces 45 which support the shoes on each of the pair of side plates. As in the embodiment of FIGS. 1–5, the end surfaces 46 at the back of the shoes, are substantially perpendicular to the support surfaces 45.

An advantage of the embodiment of FIG. 8 is that under high pressures the shoes are caused to follow paths which are similar to the paths of the gears as the gears are deflected as shown by the arrows due to the pressure in the high pressure pocket and the wedge effect of the bearing oil. This arrangement insures that under all pressure conditions there will be a good seal between the shoes and the gear teeth.

Pumps and motors formed according to the invention are relatively insensitive to temperature changes. Since the clearance space between the radial sealing shoes and the gear teeth is dictated by the pressure plates on which the shoes are supported and since the pressure plates and the gears can and are desirably made of material having the same coefficient of expansion, such as steel, the clearance space remains constant despite wide variations in temperature, even though the housing is made of material such as aluminum having a different coefficient of expansion.

It should be evident from the foregoing that the features of the invention described above are also applicable to gear motors of either the reversible or non-reversible type. In the case of a reversible motor, floating shoes of the kind illustrated are provided on both sides of the gear elements.

We claim:

1. In a fluid pump or motor of the gear type having a pair of intermeshing externally toothed gears mounted for rotational movement within a housing, said housing having a pair of ports disposed on opposite sides of the gears for admission and discharge of operating fluid, the housing being relieved in a region extending across the width of the gear teeth, a pair of sealing members each being spaced radially from one of said gears, a recess in the housing adjacent one of said ports, said radially spaced sealing members each being disposed in said recess and each having and arcuate sealing surface conforming to the path of the tips of the gear teeth and forming with the gear teeth a zone of high pressure in communication with said adjacent port, each said sealing surface extending from a point adjacent the port at higher pressure for a distance sufficient to span the tips of adjacent teeth of the adjacent gear and extending transversely of the gears, each said radially spaced sealing member having a pair of supports extending in opposite directions beyond the gear side surfaces, said supports each having a planar support surface, means having planar support surfaces interfacing with the surfaces on said supports and transmitting load to the housing, said support means being constructed to limit movement of the radially spaced sealing members to a position of sealing relationship with said gear teeth and for transmitting the load imposed on the radially spaced sealing members directly into said housing.

2. Equipment according to claim 1 wherein each said radially spaced sealing member has a back surface substantially perpendicular to said planar support surfaces and wherein said recess has interfacing planar surfaces.

3. Equipment according to claim 1 wherein said means interfacing with the planar surfaces on said supports comprises a pair of inclined planar surfaces forming a shallow recess having its apex pointed towards the mesh region of said gears, said planar surfaces being oriented and inclined to direct the forces on said radially spaced sealing members along the paths of deflection of the gears.

4. Equipment according to claim 1 wherein the means interfacing with the planar surfaces on said supports comprises pressure compensated side plates have an oval configuration, said side plates being mounted for limited movement against the sides of said gears under the action of the discharge pressure, said side plates being in contact with the housing portions adjacent the port at lower pressure for transmission of the load imposed on the radially spaced sealing members directly into the housing.

5. Equipment according to claim 1 wherein said radially spaced sealing members have a pair of parallel front faces exposed to said high pressure, said parallel faces having a substantial dimension in the direction perpendicular to the planar support surfaces, each said shoe having a stepped back with a relatively small step adjacent said sealing surface and a relatively large step, sealing means in said relatively large step, said seal being located adjacent said relatively small step whereby the pressure acting on the front faces of said radially spaced sealing members is counteracted by pressure acting on a substantial area of the back faces of said sealing members.

6. In a fluid pump or motor of the gear type having a pair of intermeshing externally toothed gears mounted for rotational movement within a housing, said housing having a pair of ports of low and high pressure disposed on opposite sides of the gears for admission and discharge of operating fluid, the housing being relieved in a region extending across the width of the gear teeth, a recess in the housing adjacent the high pressure port, a pair of sealing members each positioned in said recess and located radially adjacent to one of said gears, said sealing members each having an arcuate sealing surface conforming to the path of the tips of the gear teeth, each said sealing surface extending from a line adjacent the port at high pressure for a distance sufficient to span the tips of adjacent teeth of the adjacent gear and extending across the width of the gear teeth, each said sealing member having a surface spaced from the sealing surface and exposed to the pressure existing in the port at high pressure for urging the sealing surface into sealing relationship with the tips of the teeth, each sealing member having a pair of supports extending in opposite directions beyond the gear side surfaces, said supports each having a planar support surface, means having planar support surfaces interfacing with the planar surfaces on said supports and transmitting load to the housing, said interfacing support surfaces being positioned to limit movement of the sealing members in a direction toward the gear teeth and serving to transmit load from the sealing members directly to said housing.

7. A fluid pump or motor as defined in claim 6 in which the interfacing support surfaces are located in a plane extending parallel to a plane containing the axes of the gears.

8. A fluid pump or motor as defined in claim 6 wherein said interfacing support surfaces are inclined towards the region of mesh of the gears.

* * * * *